United States Patent [19]

Bunney

[11] Patent Number: 5,011,024

[45] Date of Patent: Apr. 30, 1991

[54] ROTARY LOG SORTER

[76] Inventor: Leroy R. Bunney, P.O. Box 1081, Everett, Wash. 98206

[21] Appl. No.: 425,673

[22] Filed: Oct. 23, 1989

[51] Int. Cl.[5] ..... B07C 5/14

[52] U.S. Cl. ..... 209/517; 198/370; 209/655; 209/698; 209/941; 209/942; 414/745.7

[58] Field of Search ..... 209/517, 655, 706, 941, 209/942, 686, 919, 518, 698; 414/745.7, 746.4; 198/370, 441, 463.5

[56] References Cited

U.S. PATENT DOCUMENTS

| | | | |
|---|---|---|---|
| 3,379,306 | 4/1968 | Mathias et al. | 209/919 X |
| 3,497,084 | 2/1970 | Murrah | 414/21 |
| 3,610,437 | 10/1971 | Barakov et al. | 414/745.7 |
| 3,613,885 | 10/1971 | Rehse | 209/919 X |
| 3,757,927 | 9/1973 | Gable et al. | 414/745.7 X |
| 3,785,485 | 1/1974 | Blinder | 209/698 X |
| 3,810,540 | 5/1974 | Georges | 209/924 X |
| 4,624,361 | 11/1986 | Hollins | 198/463.5 |

*Primary Examiner*—Donald T. Hajec
*Attorney, Agent, or Firm*—Mark Zovko

[57] ABSTRACT

A rotary drum log sorter for sorting logs received from a log feeder adjacent to the log sorter. A circular rotating drum is mounted to a frame and has a set of circumferential pockets for receiving logs from the log feeder as the pocket rotates to a position adjacent to the log feeder. Gates are provided which are mounted to the frame and adjacent to the rotating drum. The gates can be in a closed position so that a log in a pocket of the drum is prevented from leaving the packet as the pocket rotates past the closed gate. The gates also can be in an open position which will allow a log to drop from the pocket. An operator using conventional controls linked to the gates can selectively permit a log to drop from a pocket into a given collection bin.

3 Claims, 3 Drawing Sheets

ROTARY LOG SORTER

DESCRIPTION

1. Field of the Invention

The present invention relates to an apparatus for sorting logs. More particularly, this invention relates to a rotary drum log sorter for sorting logs received from a log feeder adjacent to the sorter. The apparatus allows an operator to size or grade a bundle of logs.

2. Prior Art Discussion

In the logging industry, various problems have been encountered when the need to sort or grade logs according to diameter arises. Prior systems have encountered significant maintenance problems as sorting devices have generally relied on reciprocating motion and the inherent wear on the machine thereby. Further, the devices are relatively slow due to the weight of the logs and limitations as to the frictional wear which the machines can withstand without constant breakdown. The present invention, relying on rotary motion with multiple transporting pockets, reduces the number of cycles the apparatus must endure to sort a given number of logs and minimizes maintenance of the sorter. Applicant is unaware of any patents which use a multi-pocketed rotary drum to sort logs; however, a search of the prior art revealed the following patents:

| Inventor | U.S. Pat. No. |
|---|---|
| Lipkin | 2,263,811 |
| Pysti | 3,581,891 |
| Boyle | 3,254,764 |
| Maki-Hoimela et al | 4,318,807 |
| Pysti | 4,358,009 |
| Rehse | 3,613,885 |
| Whitesell | 2,354,628 |
| Oyston | 2,581,698 |

U.S. Pat. Nos. 4,358,009, 4,318,807, 3,254,764 and 3,581,891 show lumber or timber sorters which use a "grasping" or hook type device to hold a piece of timber under as it is dropped in a suitable bin. These devices would be unsuitable for sorting logs with the efficiency of the present invention, and are much different in structure and result. The pockets of the present invention enable a log to be instantly received without hindrance and instantly discharged, unlike the hooklike members of that group of patents.

U.S. Pat. Nos. 3,613,885, 2,354,628 and 2,581,698 show inspecting or sorting devices for other articles other than logs. Whitesell in U.S. Pat. No. 2,354,628 shows multiple "pockets" and destinations for the projectiles which are to be inspected. Other than pockets, this patent does not show the complimentary apparatus contained in the present invention.

U.S. Pat. No. 3,613,885 shows a recess for transporting articles, but not even a pocket. U.S. Pat. No. 2,581,698 differs in structure and function with respect to the present invention.

Lipkin in U.S. Pat. No. 2,263,811 shows pockets to transmit logs along a conveyor belt, but does not have the gates and other features of the present invention. None of the patents in the search disclose the shape of applicant's pockets. This particular shape of applicants pockets will allow the apparatus to generate a relatively high number of RPMs.

SUMMARY OF THE INVENTION

The present invention is a rotary drum log sorter for sorting logs received from a log feeder adjacent to the log sorter. The sorter has a frame of preferably heavy gauge steel, and a rotating drum mounted to the frame. The rotating drum is substantially circular in cross section and has a set of circumferential pockets for receiving logs from the log feeder as the pocket rotates to a position adjacent to the log feeder. The apparatus also has gates which are mounted to the frame and adjacent to the rotating drum. The gates can be in a closed position so that a log in a pocket of the drum is prevented from leaving the pocket as the pocket rotates past the closed gate. The gates also can be in an open position which will allow a log to drop from the pocket. An operator would operate conventional control apparatus linked to the gates so that the log received into the pockets can be selectively permitted to drop from the pocket into a collection bin.

In the preferred embodiment of the present invention the rotary drum would have three pockets equally spaced circumferentially on the drum. The pockets also would have rounded contours with a radial depth greater than the greatest diameter of the logs to be sorted. The apparatus would have two gates in its preferred embodiment; an upper gate and a lower gate. Logs exiting from the upper gate would drop to one given collection area, while the logs dropping from the lower gate would drop to another collection area. The lower gate would be located, relative to the rotary drum, at a position such that a log which was prevented from exiting from a pocket due to the lower gate being closed will drop from the pocket into a third collection area after the pocket rotates beyond the lower gate. The gates are operated by conventional hydraulic cylinders, and due to their weight and function would preferably have shock absorbers connected thereto. In the best embodiment of the invention, each gate would have an upper and lower pair of shock absorbers to absorb the great shock on each gate from opening and closing rapidly.

From the above, it can be said that a prime object of the present invention is to provide a rotary log sorter which reduces maintenance problems encountered by present log sorters and due to its structure can operate at a low RPM, yet deliver a relatively high number of logs. Typically, if the rotary drum is rotating at 20 RPM, the sorter is delivering 60 logs per minute to the collecting bins.

DESCRIPTION OF THE PREFERRED EMBODIMENT

Figure 1:
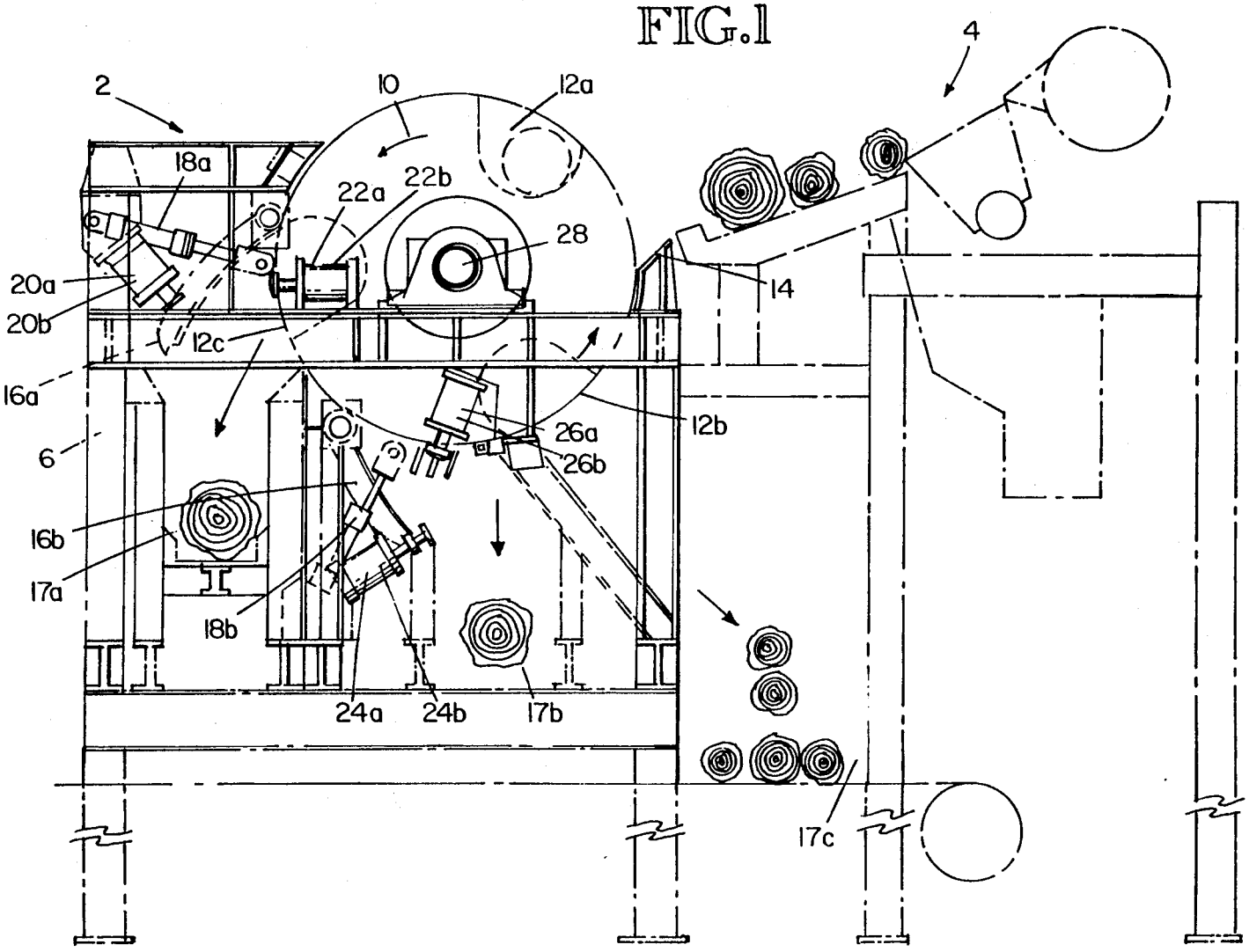
FIG. 1 is a partially schematic side elevation of an apparatus for sorting logs in accordance with the present invention.

Referring to the Figures, a rotary log sorter generally designated as 2 is shown. Rotary log sorter 2 receives logs from a belt or other feeding system 4 located adjacent to the sorter 2. The function of the feeding system 4 is to serve logs to the rotary log sorter 2, one log at a time. Rotary log sorter 2 has a frame 6 holding a rotating drum 10 with three cut-out perimeter portions or pockets 12*a*, 12*b*, and 12*c*. The pockets 12*a*, 12*b* and 12*c* receive the logs from the feeding system. As the drum 10 rotates in the counter-clockwise direction, the pockets 12*a*, 12*b* and 12*c* pick up a log resting on the drum surface and the ramp 14 which is next to the drum 10. The pockets 12*a*, 12*b* and 12*c* have a generally rounded contour, and are otherwise shaped such that they are able to easily receive the logs from the feeding system, and are able to easily dispose of the logs at a later point in the sorting cycle. It should be noted that ramp 14 and the angle at which it is positioned are to assist the receiving of logs in the pockets 12*a*, 12*b* and 12*c*.

Rotary Sorter 2 has a pair of gates designated as 16*a* and 16*b*. Gates 16*a* and 16*b* are hinged to frame 6 and can swing from an open position which will allow a log in a pocket rotating past the open gate to drop to a closed position which will prevent a log contained in a pocket rotating past the gate from dropping out of the drum 10. If, for example, a log contained in a pocket rotates past gate 16*a* when it is in an open position, that log will drop to a collecting bin 17*a*. If gate 16*a* is closed and the drum 10 continues to rotate until the pocket is next to gate 16*b* and gate 16*b* is opened, the log will drop into collecting bin 17*b*. Assuming that gate 16*b* is closed as the pocket containing the log rotates past, the drum will continue to rotate and discharge the log from the pocket into a third collecting area 17*c*. As the drum 10 continues to rotate, the pocket will then be in place to receive the next log at ramp 14 from feeding system 4.

Figure 2:
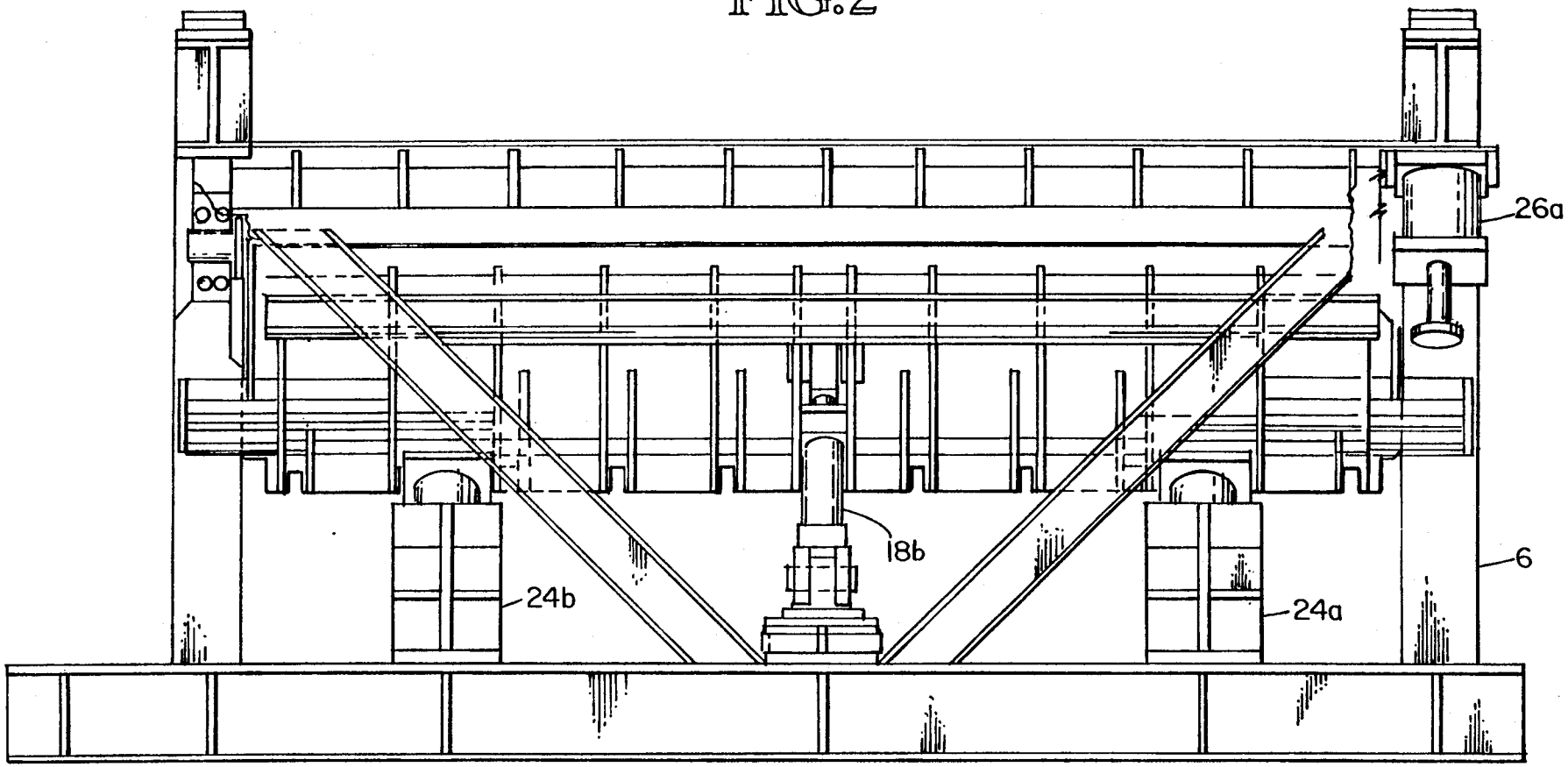
FIG. 2 is a front view of the apparatus of the present invention.
Figure 3:
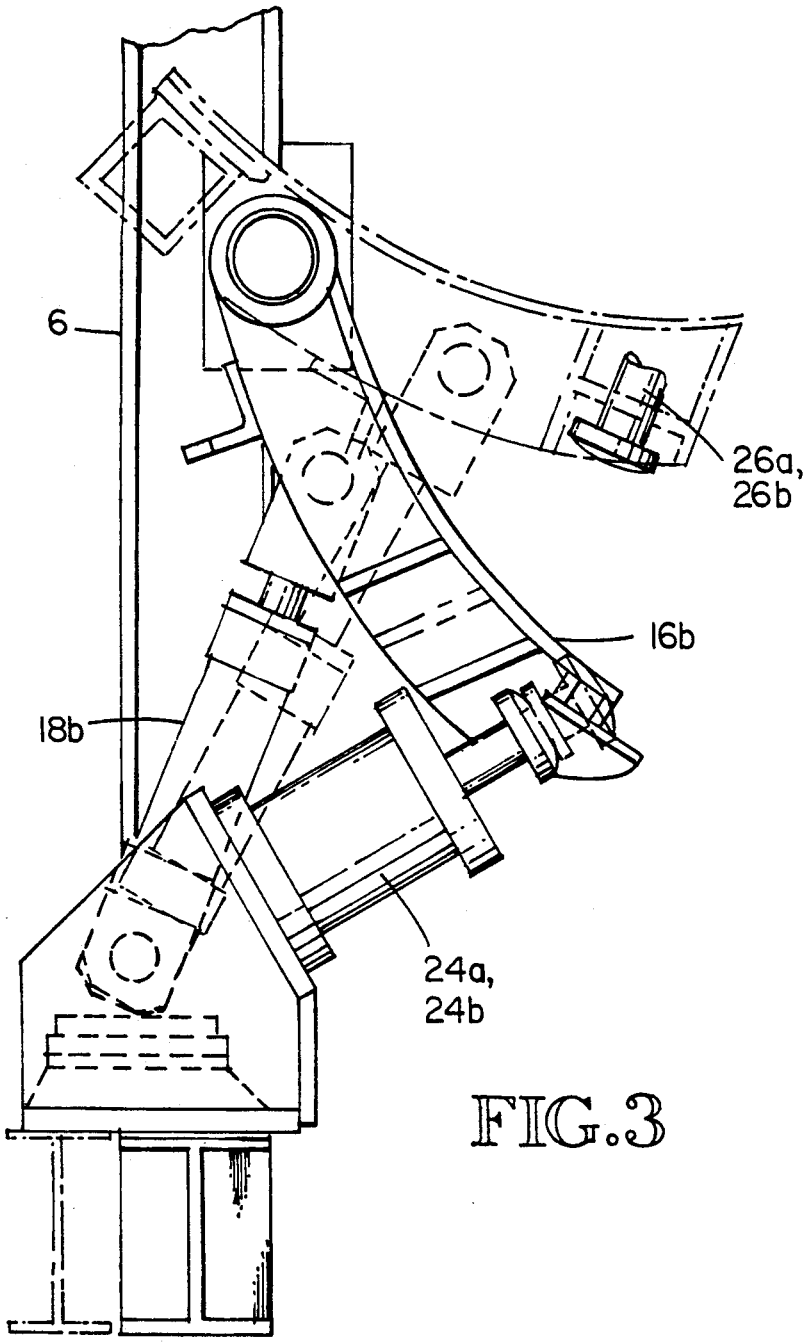
FIG. 3 is a partially sectional detail of a preferred gate of the present invention.

Gates 16*a* and 16*b* are connected to hydraulic cylinders 18*a* and 18*b* respectively which are mounted on frame 6. The hydraulic cylinder 18*a* and 18*b* can be conventional cylinders well known in the art. The apparatus provides shock absorbers 20*a* and 20*b*, and 22*a* and 22*b* mounted to frame 6. Shock absorber 20*a* and 20*b* absorbs the shock of the gate 16*a* swinging open. Shock absorber 22*a* and 22*b* absorbs the shock of gates 16*a* closing. Similar shock absorbers are provided for gate 16*b*. Shock absorbers 24*a* and 24*b* absorb the impact of gate 16*b* opening while shock absorbers 26*a* and 26*b* absorb the shock of gate 16*b* closing. As seen best in FIG. 2, the hydraulic cylinders for each gate are disposed between each shock absorber pair for that gate. It should be noted that a conventional motor (not shown) can drive drum 10 through the rotation of longitudinal shaft 28 through the middle of the drum.

In operation of the rotary drum sorter 2, an operator with suitable controls can size or grade logs running therethrough. With a conventional control system to operate the gates 16*a* and 16*b*, the operator can visually observe the logs as they are received in a pocket and drop the logs into an appropriate collecting bin 17*a*, 17*b* or 17*c* by the opening or closing of gates 16*a* and 16*b*.

The invention may be embodied in other forms without departing from one spirit or essential characteristicis thereof. The present embodiments are therefore to be considered in all respects as illustrative and not restrictive, the scope of the invention being indicated by the append claims rather than the foregiong description, and all change which comes within the meaning and range of equivalency of claims are intended to be embraced therein.

What I claim is:

1. A rotary drum log sorter for sorting logs received from a log feeder adjacent to the log sorter comprising a. a frame;

b. a rotating drum mounted to said frame, said drum being substantially circular in cross section and having circumferential pocket means adapted to receive logs;

c. gate means hingably mounted to said frame and adjacent to said rotating drum, said gate means having a closed position wherein a log in said pocket means of said rotating drum is prevented from leaving said pocket means as said pocket means rotates past said gate means in the closed position, said gate means having an open position wherein a log in said pocket means will exit from said pocket means as said pocket means rotates past said gate means in the open position, said gate means including an upper first gate and a lower second gate, said upper first gate and said lower second gate so arranged spatially that as said drum rotates about a horizontal axis, the first and second gates, when in a closed position, prevent the gravity discharge of the logs at respective first and second discharge positions, and there being a third discharge position, so located relative to the first and second gates, that any logs not discharged at the first and second discharge position are discharged at the third position; and d. first shock absorbing means mounted to said frame for absorbing the shock of said gate means swinging open.

2. The apparatus of claim 1 which includes second shock absorbing means mounted to said frame for absorbing the shock of said gate means swinging closed.

3. The apparatus of claim 2 wherein said pocket means includes three pockets spaced equally apart on the circumference of said rotary drum.

* * * * *